US007559108B2

(12) United States Patent
Forte

(10) Patent No.: US 7,559,108 B2
(45) Date of Patent: Jul. 14, 2009

(54) MULTI-POSITION EXTENDABLE LINT AND PET HAIR REMOVER

(76) Inventor: Chad Forte, 4075 S. Crystal Cir. #203, Aurora, CO (US) 80014

( * ) Notice: Subject to any disclaimer, the term of this patent is extended or adjusted under 35 U.S.C. 154(b) by 0 days.

(21) Appl. No.: 11/945,198

(22) Filed: Nov. 26, 2007

(65) Prior Publication Data

US 2008/0120797 A1 May 29, 2008

Related U.S. Application Data

(60) Provisional application No. 60/861,005, filed on Nov. 27, 2006.

(51) Int. Cl.
*A47L 25/00* (2006.01)
*A47L 25/08* (2006.01)

(52) U.S. Cl. ..... 15/104.002; 15/144.1; 15/144.4; 15/230.11; 239/52; 239/57; 239/60; 492/13

(58) Field of Classification Search ..... 15/104.002, 15/144.1, 144.4, 230.11; 239/52, 57–60; 422/5; 492/13
See application file for complete search history.

(56) References Cited

U.S. PATENT DOCUMENTS

| | | | | |
|---|---|---|---|---|
| 4,727,616 | A | 3/1988 | Kucera et al. | 15/104 |
| 5,924,157 | A * | 7/1999 | Barela | 15/104.002 |
| 6,055,695 | A | 5/2000 | McKay, Jr. | 15/104.002 |
| 6,127,014 | A | 10/2000 | McKay, Jr. | 428/43 |
| 6,427,278 | B1 | 8/2002 | McKay, Jr. | 15/104.002 |
| 7,020,926 | B2 | 4/2006 | McKay | 15/104.002 |
| 7,047,587 | B2 | 5/2006 | Heidel | 15/104.002 |
| 2005/0204493 | A1 * | 9/2005 | Legus et al. | 15/104.002 |
| 2006/0288508 | A1 | 12/2006 | Knopow et al. | 15/144.1 |

* cited by examiner

*Primary Examiner*—Mark Spisich
(74) *Attorney, Agent, or Firm*—Stanley J. Gradisar

(57) ABSTRACT

A rolling lint and pet and human hair remover will function in at least two different positions and with the option of extending the handle in order to reach hard to reach places for use in automobiles, homes, and other locations, as well as on a person's clothing. The handle is foldable against the lint roller portion for compact storage and for use in tight places. An air-freshener body may be incorporated into the lint roller portion. Air-freshener beads are placed inside the air-freshener body and give off an aromatic fragrance while the lint remover is in use due to the tumbling action of the air-freshener beads inside the lint roller as it is rolled. A plurality of holes in the air-freshener body allow the aromatic fragrance to flow out and away from the lint roller.

10 Claims, 7 Drawing Sheets

MULTI-POSITION EXTENDABLE LINT AND PET HAIR REMOVER

CROSS-REFERENCES TO RELATED APPLICATIONS

This application claims the benefit of U.S. Provisional Application Ser. No. 60/861,005 filed on Nov. 27, 2006, titled "TWO POSITION EXTENDABLE LINT AND PET HAIR REMOVER" which is incorporated herein by reference in its entirety for all that is taught and disclosed therein.

BACKGROUND

The present invention relates to the general art of tools, and to the particular field of dust and lint removers. There are many previously known lint roller assemblies which typically comprise a handle secured to a cylindrical lint roller support. A tubular cylindrical adhesive lint roller is then removably mounted to the support such that the adhesive roller is rotatable relative to the handle. In use, the adhesive lint roller is rolled along a user's clothes or other surfaces to remove lint, hair and other debris.

SUMMARY

This Summary is provided to introduce in a simplified form a selection of concepts that are further described below in the Detailed Description. This Summary is not intended to identify key features or essential features of the claimed subject matter, nor is it intended to be used to limit the scope of the claimed subject matter.

The detailed description below describes a rolling lint and pet and human hair remover that will function in at least two different positions with the option of extending the handle to reach hard to reach areas for use in automobiles, homes, and other locations as well as on a person's clothing, and that also freshens the air around the immediate area of use.

DETAILED DESCRIPTION

Figure 1:
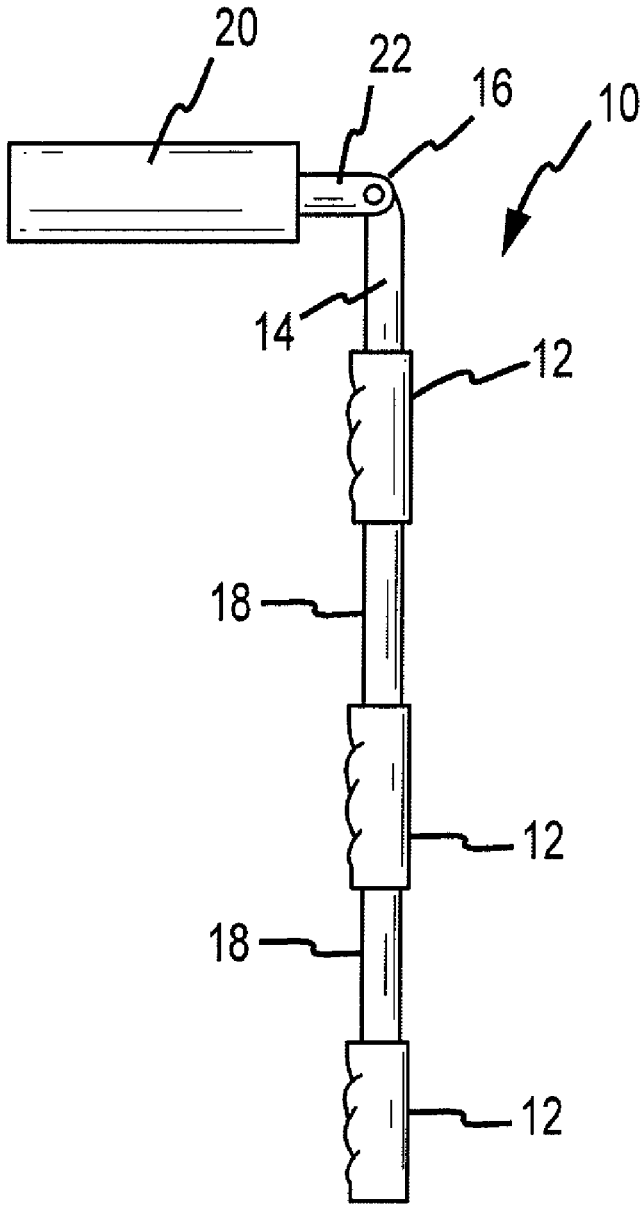
FIG. 1 shows an elevation view of an embodiment of a lint remover with the handle extended and in a bent position.
Figure 2:
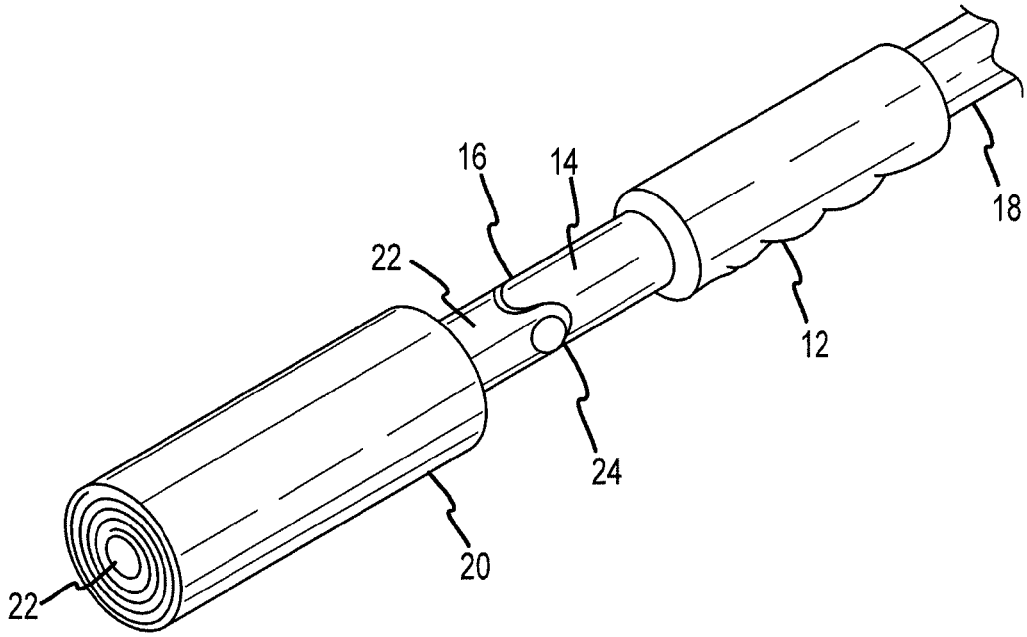
FIG. 2 shows a partial perspective view of the lint remover of FIG. 1 with the handle in a straight position.

Referring now to the Figures, in which like reference numerals and names refer to structurally and/or functionally similar elements thereof, FIG. 1 shows an elevation view of an embodiment of a lint remover with the handle extended and in a bent position and FIG. 2 shows a partial perspective view of the lint remover of FIG. 1 with the handle in a straight position. Referring now to FIGS. 1 and 2, Lint Remover 10 includes Hand Grips 12 on one end of a Handle 14 which has a Pivot Connection 16 on the other end thereof. A Lint Roller 20 is rotatably mounted on a Support Bar 22 that is pivotally connected to Handle 14 by the Pivot Connection 16. Pivot Connection 16 has a Release Button 24 so Lint Roller 20 can be positioned and oriented in a straight or bent position with respect to the Handle 14 by pushing in on Release Button 24. Pressing Release Button 24 allows Handle 14 and Support Bar 22 to pivot about Pivot Connection 16. When released, Release Button 24 locks Handle 14 in relation to Support Bar 22. Release Button 24 may have two, three, four, or more predefined mechanical locked positions defining the angle between Handle 14 and Support Bar 22 such as 45°, 90°, 135°, or 180°. Release Button 24 may also be of a design that is friction based such that any angle desired between Handle 14 and Support Bar 22 may be fixed into place. Various locked angle relationships may thus be established between Handle 14 and Support Bar 22 via Pivot Connection 16 as desired.

Telescoping Members 18 allow Handle 14 to be extended. Hand Grips 12 are rotatable about Telescoping Members 18 to tighten and loosen their friction grip on Telescoping Members 18. In a non-extended position, Hand Grips 12 butt up against each other, and Telescoping Members 18 are not visible, but are slidably retracted inside of each other. In other embodiments, there may be only one Hand Grip 12 and no Telescoping Members 18 as shown in FIGS. 3-8.

Lint Roller 20 contains a series of concentric sheets that are sticky on the outer facing surface that are wound around a hollow tube. The concentric sheets have at least one perforated portion running along a length of Lint Roller 20. After use for a period of time, the outermost concentric sheet may lose its stickiness and no longer be able to pick up lint, hair, or other debris. When this occurs, the outermost concentric sheet may be torn along the perforation and discarded, revealing the next fresh concentric sheet underneath. This process is repeated until the last concentric sheet is used up. Another Lint Roller 20 may then be secured to Support Bar 22.

Figure 3:
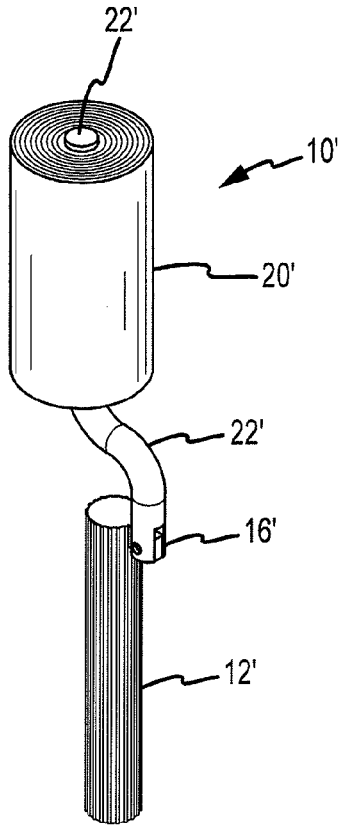
FIG. 3 shows a perspective view of another embodiment of a lint remover in a straight position.
Figure 4:
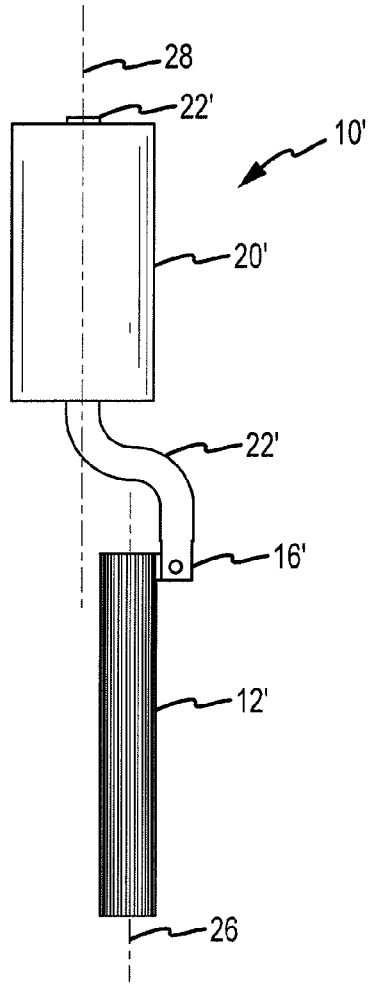
FIG. 4 shows an elevation view of the lint remover of FIG. 3 in a straight position.
Figure 5:
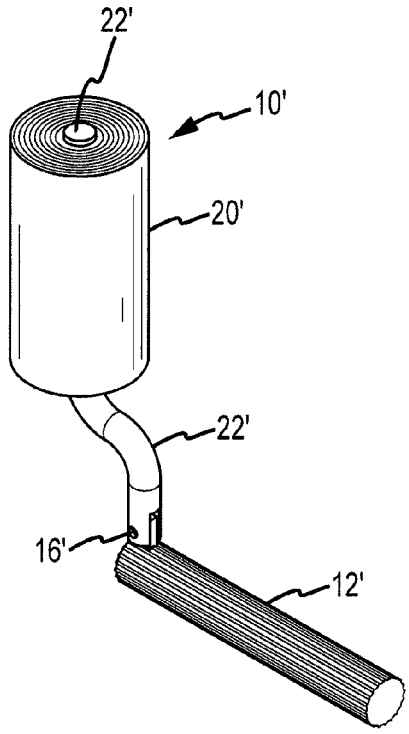
FIG. 5 shows a perspective view of the lint remover of FIG. 3 in a bent position.
Figure 6:
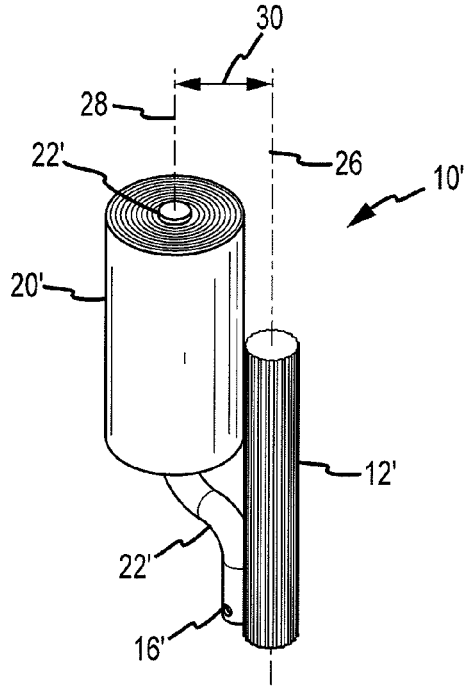
FIG. 6 shows a perspective view of the lint remover of FIG. 3 in a folded position.

FIG. 3 shows a perspective view of another embodiment of a lint remover in a straight position. FIG. 4 shows an elevation view of the lint remover of FIG. 3. FIG. 5 shows a perspective view of the lint remover of FIG. 3 in a bent position. FIG. 6 shows a perspective view of the lint remover of FIG. 3 in a folded position. Referring now to FIGS. 3, 4, 5, and 6, Lint Remover 10' has a Support Bar 22' that has an "S" shape. Pivot Connection 16' is thus in a relationship with Support Bar 22' and Hand Grip 12' which allows Hand Grip 12' to be rotated into a compact folded position (see FIG. 6) which is useful when storing Lint Remover 10' when it is not in use. Pivot Connection 16' allows movement of Support Bar 22' in relation to Hand Grip 12' from 0° (see FIG. 6) to 90° (see FIG. 5) to 180° (see FIG. 4). In this embodiment, Center Line 26 of Hand Grip 12' is offset from Center Line 28 of Lint Roller 20'.

In the compact folded position, a Gap 30 between Center Line 26 and Center Line 28 allows a user of Lint Remover 10' to grasp Hand Grip 12' with clearance of the user's fingers in relation to Lint Roller 20'. Thus, the user can operate Lint Remover 10' in tighter fitting places because Handle 14' is not extended away from Lint Roller 20'. Based upon its design, Pivot Connection 16', as described above, may have two, three, four, or more predefined mechanical locked positions defining the angle between Handle 14' and Support Bar 22', or may be friction based such that any angle desired between Handle 14' and Support Bar 22' may be fixed into place.

Figure 7:
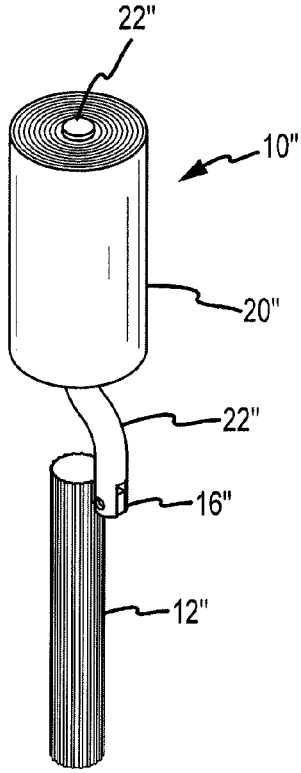
FIG. 7 shows a perspective view of another embodiment of a lint remover in a straight position.
Figure 8:
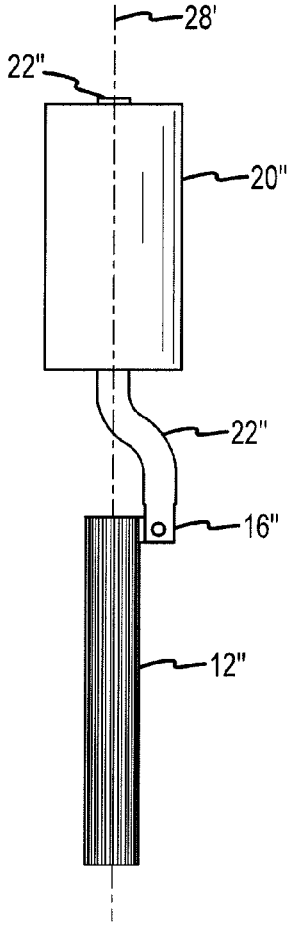
FIG. 8 shows an elevation view of the lint remover of FIG. 7 in a straight position.

FIG. 7 shows a perspective view of another embodiment of a lint remover in a straight position. FIG. 8 shows an elevation view of the lint remover of FIG. 7 in a straight position. Referring now to FIGS. 7 and 8, in this embodiment of Lint Remover 10" Center Line 28' of Lint Roller 20" is also the center line of Hand Grip 12". The "S" shape of Support Bar 22" is not as pronounced as that shown in FIGS. 3-6. In the folded compact position, Hand Grip 12" will be in much closer proximity to Lint Roller 20" such that a user would not be able to get their fingers between Hand Grip 12" and Lint Roller 20", but still could grasp Hand Grip 12" more with the tips of their fingers in order to still utilize Lint Remover 10" in the folded compact position.

Figure 9A:
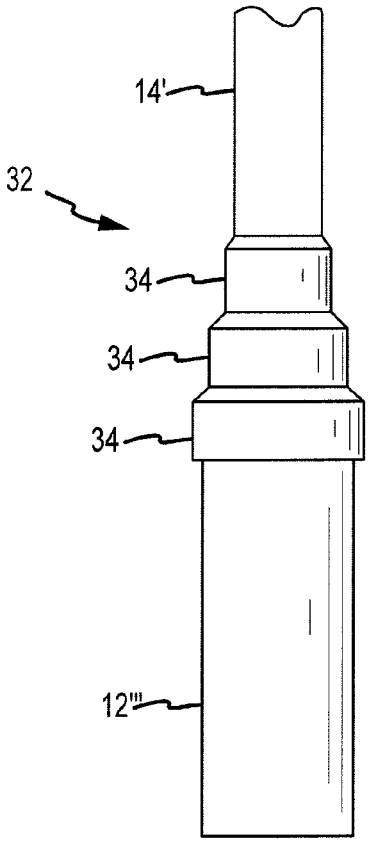
FIGS. 9A and 9B show an embodiment of an extendible handle in the non-extended and extended positions for use with any of the lint removers shown in FIGS. 1-8.
Figure 9B:
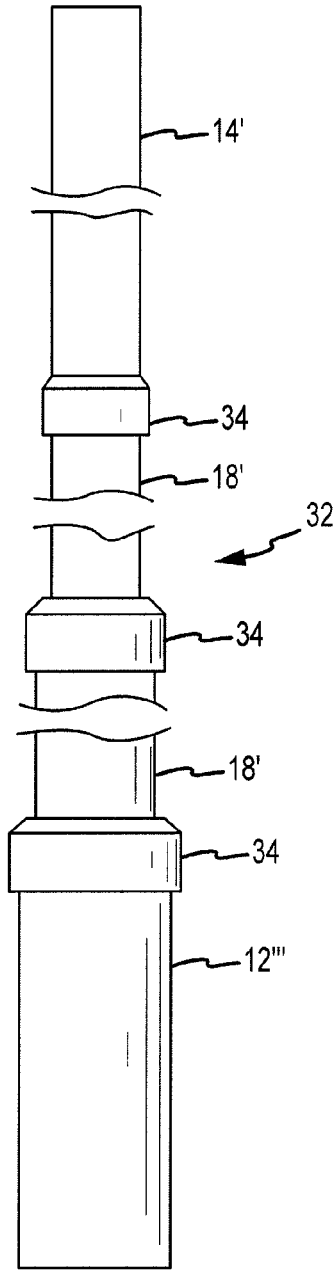

FIGS. 9A and 9B show an elevation view of an embodiment of an extendible handle in the non-extended and extended positions for use with any of the lint removers shown in FIGS. 1-8. Referring now to FIGS. 9A and 9B, Extendible Handle 32 has Hand Grip 12'" that has Telescoping Members 18' which are releasably extendible through the action of Collars 34. Collars 34 are rotatable about Telescoping Members 18' to tighten and loosen their friction grip on Telescoping Members 18'. Thus, Telescoping Members 18' may be partially or fully extended to achieve a variable length of Extendible Handle 32. Extendible Handle 32 may also be of a design where there are only two locking positions, fully extended and fully retracted. Handle 14' is retractable and extendible via the Collar 34 with which it contacts. Extendible Handle 32 may be substituted for the one shown in FIG. 1. In addition, Extendible Handle 32 may be substituted for Hand Grip 12' (FIGS. 3-6) or Hand Grip 12" (FIGS. 7-8) where the extant end of Handle 14' is attached to Support Bar 22" via Pivot Connection 16".

Figure 10C:
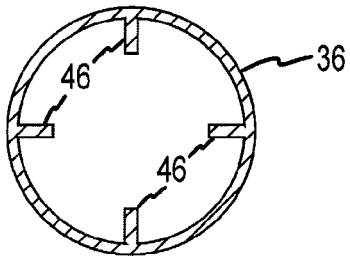
FIGS. 10A, 10B, and 10C show an embodiment of an assembly for holding air-freshening beads for use with any of the lint removers shown in FIGS. 1-8.
Figure 10B:
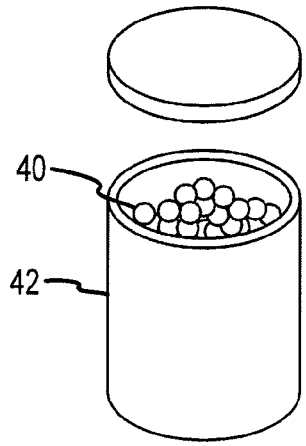
Figure 10A:
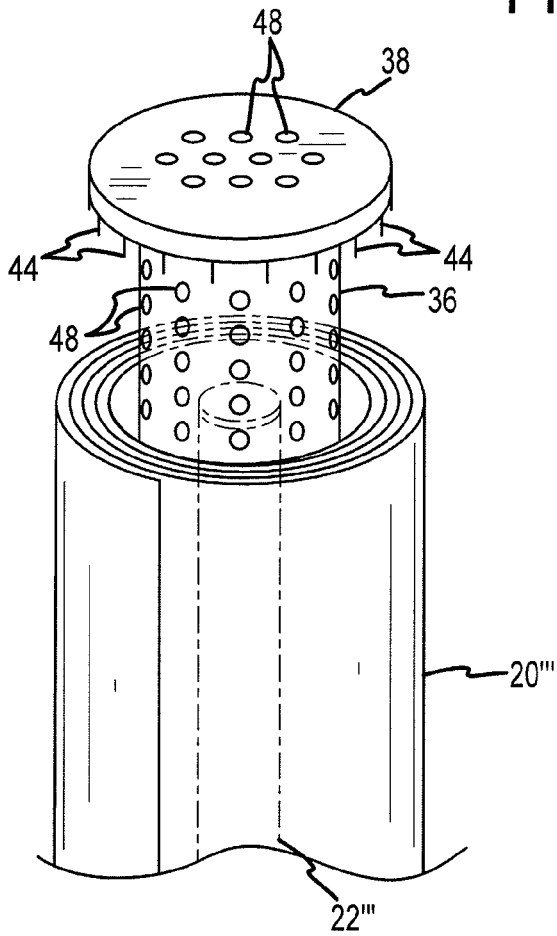

FIGS. 10A, 10B, and 10C show an embodiment of an assembly for holding air-freshening beads for use with any of the lint removers shown in FIGS. 1-8. Referring now to FIGS. 10A, 10B, and 10C, Lint Roller 20'" receives an Air-Freshener Body 36 that has a removable End Cap 38. The other end of Air-Freshener Body 36 has an opening for receiving Support Bar 22'". Air-Freshener Beads 40 (FIG. 10B), which can be purchased separately in a Container 42, are poured inside Air-Freshener Body 36. End Cap 38, which may snap on and snap off, is then snapped back on.

A cross-section view of Air-Freshener Body 36 is shown in FIG. 10C. Within the interior of Air-Freshener Body 36 are a plurality of Fins 46 which run along the length of Air-Freshener Body 36. When End Cap 38 is snapped back on, a plurality of Tines 44 located around the circumference of End Cap 38 insert themselves within the series of concentric sheets of Lint Roller 20'". As a result, when Lint Roller 20'" is rolled over a surface, Air-Freshener Body 36 rotates along with the rolling movement of Lint Roller 20'" such that the Fins 46 help to agitate and tumble the Air-Freshener Beads 40 inside Air-Freshener Body 36, helping to give off the aromatic fragrance of the Air-Freshener Beads 40. A plurality of Holes 48 are located in End Cap 38 and Air-Freshener Body 36 which allow the fragrance to flow out and away from Lint Roller 20'".

Other connecting structures besides Tines 44 may be utilized to enable Air-Freshener Body 36 to rotate along with the rolling movement of Lint Roller 20'". In another embodiment, End Cap 38 may be sized so that the outer circumference fits frictionally snugly inside the inner circumference of the hollow tube of Lint Roller 20'", eliminating the need for Tines 44. In another embodiment, End Cap 38 may be sized to be approximately the same circumference as Air-Freshener Body 36 but with two or more protrusions that extend radially from the center of End Cap 38 that fit frictionally snugly inside the inner circumference of the hollow tube of Lint Roller 20'", also eliminating the need for Tines 44. The gaps between the protrusions of End Cap 38 allow additional avenues for air flow, besides Holes 48, allowing the fragrance of the Air-Freshener Beads 40 to flow out and away from Lint Roller 20'". Thus, when any of the lint removers shown in FIGS. 1-8 are situated with Air-Freshener Body 36, the lint roller will freshen the air while removing lint, hair, and other debris from various surfaces.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. It will be understood by those skilled in the art that many changes in construction and widely differing embodiments and applications will suggest themselves without departing from the scope of the disclosed subject matter.

What is claimed is:

1. A lint remover comprising:

a handle;

a hand grip connected to said handle;

a support bar;

a pivot connection that movably connects said handle to said support bar;

at least one telescoping member in cooperation with said handle and said hand grip;

a lint roller attachable to said support bar through an opening in a first end of said lint roller, wherein said lint roller has a plurality of concentric sheets that are sticky on an outer surface; and an air-freshener body receivable into a second end of said lint roller, wherein said air-freshener body further comprises:

a first opening in a first end of said air-freshener body for receiving said support bar;

a second opening in a second end of said air-freshener body;

an end cap that is removably received in said second opening, said end cap having a plurality of holes there through;

an interior chamber located between said first end and said second end of said air-freshener body;

at least one fin located within said interior chamber and running along a length of said interior chamber;

a plurality of holes there through in said air-freshener body; and a plurality of air-freshener beads located within said interior chamber of said air-freshener body, wherein when said lint roller is rolled over a surface, said air-freshener body rotates along with said lint roller such that said at least one fin agitates and tumbles said plurality of air-freshener beads inside said air-freshener body, thereby helping to give off an aromatic fragrance of said plurality of air-freshener beads through said plurality of holes in said end cap and said plurality of holes in said air-freshener body.

2. The lint remover according to claim 1 wherein said pivot connection further comprises:

a release button, wherein depressing said release button allows said handle and said support bar to pivot about said pivot connection, and releasing said release button locks said handle in relation to said support bar.

3. The lint remover according to claim 2 wherein said release button further comprises:

at least two predefined mechanical locked positions defining an angle between said handle and said support bar.

4. The lint remover according to claim 1 further comprising:

a gap between a center line of said lint roller and a center line of said handle when said lint roller and said handle are in a compact folded position, wherein a user may grasp said handle when the lint remover is in said compact folded position and have clearance in said gap for a fingers of said user.

5. The lint remover according to claim 1 wherein said pivot connection further comprises:

a friction based connection such that any desired angle between said handle and said support bar between 0° to 180° may be achieved.

6. The lint remover according to claim 1 further comprising:

an additional hand grip associated with each of said at least one telescoping members.

7. The lint remover according to claim 1 further comprising:

a plurality of tines located on a circumference of said end cap that insert themselves within the said plurality of concentric sheets of said lint roller.

8. The lint remover according to claim 1 further comprising:

an outer circumference of said end cap, wherein said outer circumference of said end cap fits frictionally snugly inside an inner circumference of said lint roller.

9. The lint remover according to claim 1 further comprising:

at least one collar in cooperation with said at least one telescoping member wherein said at least one telescoping member is releasably extendible and retractable through a rotating action of said at least one collar.

10. The lint remover according to claim 1 further comprising:

at least one hand grip in cooperation with said at least one telescoping member wherein said at least one telescoping member is releasably extendible and retractable through a rotating action of said at least one hand grip.

* * * * *